United States Patent [19]

Resch

[11] 4,034,449

[45] July 12, 1977

[54] DEVICE FOR CRIMPING AND SHEARING CONTACTS FROM CONTACT STRIPS

[75] Inventor: Alois Ruppert Resch, Heilbronn, Germany

[73] Assignee: Bunker Ramo Corporation, Oak Brook, Ill.

[21] Appl. No.: 676,304

[22] Filed: Apr. 12, 1976

[30] Foreign Application Priority Data

Apr. 15, 1975 Germany ..... 2516450

[51] Int. Cl.[2] ..... H01R 11/08

[52] U.S. Cl. ..... 29/33 M; 29/749; 29/566.2; 83/589

[58] Field of Search .... 29/203 DT, 203 DS, 203 D, 29/33 M; 83/589

[56] References Cited

U.S. PATENT DOCUMENTS

| | | | |
|---|---|---|---|
| 2,681,447 | 6/1954 | Davis | 29/203 DT |
| 2,897,870 | 8/1959 | Berg | 29/33 M |
| 3,276,098 | 10/1966 | Berg et al. | 29/33 M |
| 3,757,626 | 9/1973 | Kulp | 83/589 X |

*Primary Examiner*—Othell M. Simpson
*Assistant Examiner*—Z. R. Bilinsky
*Attorney, Agent, or Firm*—F. M. Arbuckle; R. P. Niro

[57] ABSTRACT

The present invention relates to a device for crimping and shearing contacts of a contact strip, the device comprising a stationary crimping jaw serving as supporting means for the contact to be crimped, a second crimping jaw movable relative to the first crimping jaw, and a shearing device for shearing off the junction between the contact located on the stationary crimping jaw and the carrier strip interconnecting the contacts. The shearing device is in the form of a leaf spring adapted to fit flat on the contact strip in a position flush with the point of shearing, and cooperating with the fixed crimping jaw to effect the shearing action. The contact resting on the stationary crimping jaw is supported by the crimping jaw, and the leaf spring projects laterally beyond the crimping jaw and is adapted to be moved through a shearing stroke relative to the fixed jaw by means of a thrust member on the movable jaw.

5 Claims, 2 Drawing Figures

DEVICE FOR CRIMPING AND SHEARING CONTACTS FROM CONTACT STRIPS

BACKGROUND OF THE INVENTION

The present invention relates to a device for crimping and shearing the individual contacts of a contact strip, the device comprising a stationary crimping jaw serving as supporting means for the contact to be crimped, a second crimping jaw movable relative to the first crimping jaw, and a shearing device for shearing off the junction between the contact located on the stationary crimping jaw and the carrier strip interconnecting the contacts.

In order to reduce the cost of maintaining a large stock of contacts and the work preformed in fixing the contacts on conductors, so-called contact strips are frequently employed. In these contact strips, contacts punched and formed of sheet metal blanks are interconnected by a metal strip, i.e., the contacts are not loosely separated once they have been produced until after the contacts are crimped onto the inserted conductors. In known apparatuses in which strip contacts are crimped onto conductors, shearing action is accomplished by providing cooperating shearing knives or shearing blocks on a movable crimping jaw and a fixed crimping jaw, respectively. A disadvantage of this design is that the movable crimping jaw must traverse a relatively large stroke when raising the shearing device from the stationary crimping jaw so far that the next conductor to be crimped can be easily introduced.

SUMMARY OF THE INVENTION

The object of the present invention is to provide a device of the above type having an improved shearing means not subject to the above shortcomings.

According to the present invention the object is met by providing a shearing device in the form of a leaf spring adapted to fit flat on the contact strip in a position flush with the point of shearing, and cooperating with the fixed crimping jaw to effect the shearing action. The contact resting on the stationary crimping jaw is supported by the crimping jaw, and the leaf spring projects laterally beyond the crimping jaw and is adapted to be moved through a shearing stroke relative to the fixed jaw by means of a thrust member on the movable jaw. A leaf spring, which rests flat on the carrier strip, is used in the device according to the invention to shear off the contacts from the carrier strip interconnecting the contacts.

The present invention is based on the conclusion that a leaf spring facilitates clean shearing action in an extremely simple manner. A major advantage resulting from the use of the leaf spring is that the leaf spring can be applied to the contact strip so that it presses flat against the contact carrier strip, and the conductor to be crimped can be inserted into the contact on top of the leaf spring so that the leaf spring is situated between the inserted conductor and the carrier strip. Thus, the leaf spring acts as an additional guiding member for the contact strip and yet does not increase the stroke of the movable crimping jaw.

BRIEF DESCRIPTION OF THE DRAWING

The invention will now be described in detail with reference to the accompanying drawings representing a preferred embodiment of the invention. In the drawing.

DETAILED DESCRIPTION OF THE PREFERRED EMBODIMENT

Figures 1, 2:
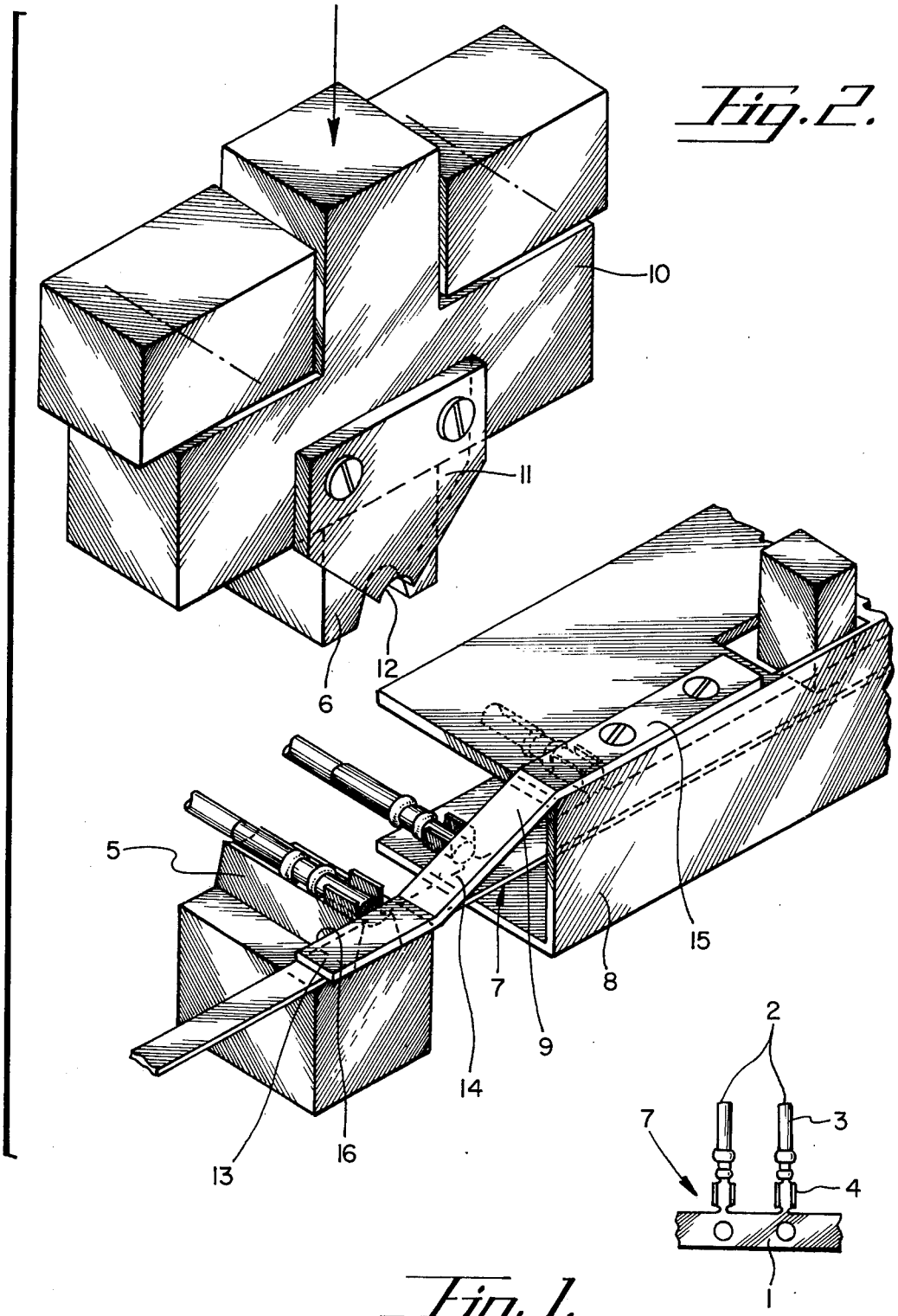
FIG. 1 shows a short section of a contact strip.
FIG. 2 is a perspective view of a preferred embodiment of the device according to the invention.

FIG. 1 shows a short section of a carrier strip 1 to which two contacts 2 are attached on spaced relationship. In the figure, contacts 2 are shown as jack contacts. The jack-shaped contact section 3 at the free end terminates in the form of a terminal for the connector to be crimped. Terminal section 4 is joined with carrier strip 1 and must be sheared off at the junction between terminal section 4 and carrier strip 1 close to terminal section 4, once the conductor has been crimped onto terminal section 4.

The device shown in FIG. 2 and used to crimp contacts onto conductors is provided with a stationary crimping jaw 5 and a movable crimping jaw 6. Contact strip 7 which is fed to crimping jaws 5 and 6 in a stepwise motion runs in a U shaped guiding rail 8 and is moved forward in steps by means of a feeding device not shown.

A leaf spring 9 attached to guiding rail 8 is located close to the stationary crimping jaw 5. The outermost end 13 of leaf spring 9 rests flat on that portion of carrier strip 1 which forms part of contact strip 7 and is near contact 2 on crimping jaw 5. The bent portion 14 which is a continuation of the horizontal portion 13 of leaf spring 9 is upwardly inclined and extends to another bent portion 15 which rests on guiding rail 8.

A thrust member 11, which at the end of the downward stroke of ram 10 engages leaf spring 9 and presses it downwardly, is attached to movable crimping jaw 6, or alternatively to the ram 10 which receives the movable crimping jaw.

Since the conductor to be crimped may be situated above leaf spring 9, a semicircular recess 12 is provided on the face of thrust member 11, facing leaf spring 9. When the crimping operation is executed, the conductor rests in the semi-circular recess 12.

Occasionally the carrier strip 1 interconnecting the contacts 2 is produced with a slight bend at the junction between carrier strip 1 and contacts 2. In such a case, it is not necessary to provide recess 12 in thrust member 11.

The edge 16 of leaf spring 9 facing crimping jaw 5 is disposed at a small distance from the front of crimping jaw 5 or from the supporting means of crimping jaw 5, so that leaf spring 9 can freely pass the front of crimping jaw 5 in a shearing action. However, the distance must not be too large, because otherwise proper shearing cannot be guaranteed. The thickness of the sheet to be sheared is the criterion for the distance.

A suitable material for the production of the leaf spring is spring steel.

What we claim is:

1. A device for crimping successive contacts of a contact strip about individual conductors and for shearing the contacts from a contact strip, said contact strip being of the type wherein a series of spaced contacts are joined to a common contact carrier strip, said device comprising:

a stationary crimping jaw for supporting a contact to be crimped;

a movable crimping jaw movable into a cooperating crimping relationship with said stationary crimping jaw for crimping a contact about a conductor; and a shearing member for cutting the junction between a contact resting on and supported by said stationary crimping jaw and the carrier strip interconnecting successive contacts; said shearing member comprising a resilient leaf spring having a portion thereof disposed below the uppermost portion of said conductor and above said contact strip and resting flat against the carrier strip portion of said contact strip, said leaf spring projecting laterally beyond said stationary crimping jaw, and having an extending edge spaced apart from an adjacent cooperating edge of said stationary crimping jaw, and said leaf spring being adapted to be moved through a shearing stroke relative to said stationary jaw.

2. The device as claimed in claim 1, including a thrust member carried by said movable crimping jaw for engaging said leaf spring and effecting said shearing stroke during crimping movement of said movable jaw.

3. The device as claimed in claim 1 wherein said leaf spring has a bend to form a ramp and a flat extended end portion for said leaf spring, said extended end portion defining said portion resting on said carrier strip.

4. The device as claimed in claim 3, wherein said leaf spring has a second bend to form a second flat extended end portion opposite and parallel to said first extended end portion, with said ramp located between said end portions, said second end portion being fixed against movement to thereby cause a biasing force against said carrier strip by said first end portion.

5. The device as claimed in claim 1 wherein the position of said leaf spring is adjustable relative to said stationary crimping jaw to vary the distance between the laterally extending edge of said leaf spring and the adjacent cooperating edge of said stationary jaw an amount sufficient to effect shearing of contact strips having different thicknesses.

* * * * *